United States Patent [19]

Hosaka

[11] Patent Number: 4,991,550

[45] Date of Patent: Feb. 12, 1991

[54] OIL PRESSURE RUSH ADJUSTER OF A DIRECTLY ACTING TYPE

[75] Inventor: Akihiko Hosaka, Tokyo, Japan

[73] Assignee: Nittan Valve Co., Ltd., Tokyo, Japan

[21] Appl. No.: 531,038

[22] Filed: May 31, 1990

[30] Foreign Application Priority Data

Jun. 2, 1989 [JP] Japan ..... 1-139326

[51] Int. Cl.[5] ..... F01L 1/24

[52] U.S. Cl. ..... 123/90.55; 123/90.37; 74/569

[58] Field of Search ..... 123/90.33, 90.37, 90.55; 74/569

[56] References Cited

U.S. PATENT DOCUMENTS

| | | | |
|---|---|---|---|
| 4,392,462 | 7/1983 | Lesher | 123/90.55 |
| 4,465,038 | 8/1984 | Speil | 123/90.55 |
| 4,579,094 | 4/1986 | Doppling et al. | 123/90.55 |
| 4,590,898 | 5/1986 | Beunte et al. | 123/90.55 |
| 4,694,790 | 9/1987 | Kowal | 123/90.55 |
| 4,715,334 | 12/1987 | Buente et al. | 123/90.55 |
| 4,745,889 | 5/1988 | Speil | 123/90.55 |
| 4,787,347 | 11/1988 | Schaeffler | 123/90.55 |
| 4,867,114 | 9/1989 | Schaeffler | 123/90.55 |

*Primary Examiner*—Charles J. Myhre
*Assistant Examiner*—Weilun Lo
*Attorney, Agent, or Firm*—Michael J. Striker

[57] ABSTRACT

A sealing device is provided on the outer circumference of an oil pressure unit of the oil pressure rush adjuster, or on the partitioning wall of a sub-reservoir surrounding the oil pressure unit, or therebetween so as to provide a sealing between said partitioning wall and said outer circumference of the oil pressure unit while the engine in which the rush adjuster is mounted is stopped and so as to allow a portion of the oil to leak therebetween while the engine operates. Since the oil is perfectly prevented, while the engine stops, from leaking between the outer circumference of the oil pressure unit and the partitioning wall of the sub-reservoir, the oil amount residing in the reservoirs is enough even though not supplied from the cylinder head, and the air cannot be drawn into the high pressure chamber.

5 Claims, 4 Drawing Sheets

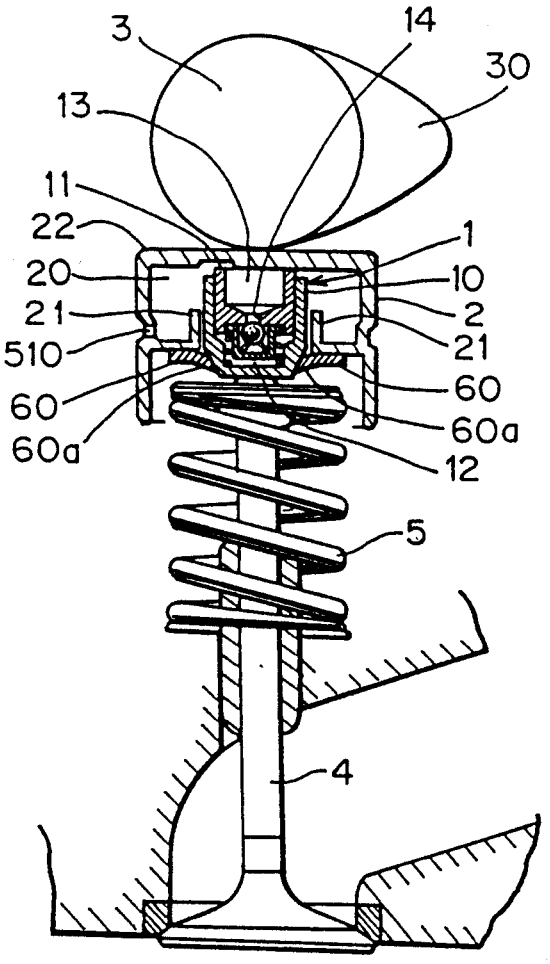
FIG_1
FIG_2
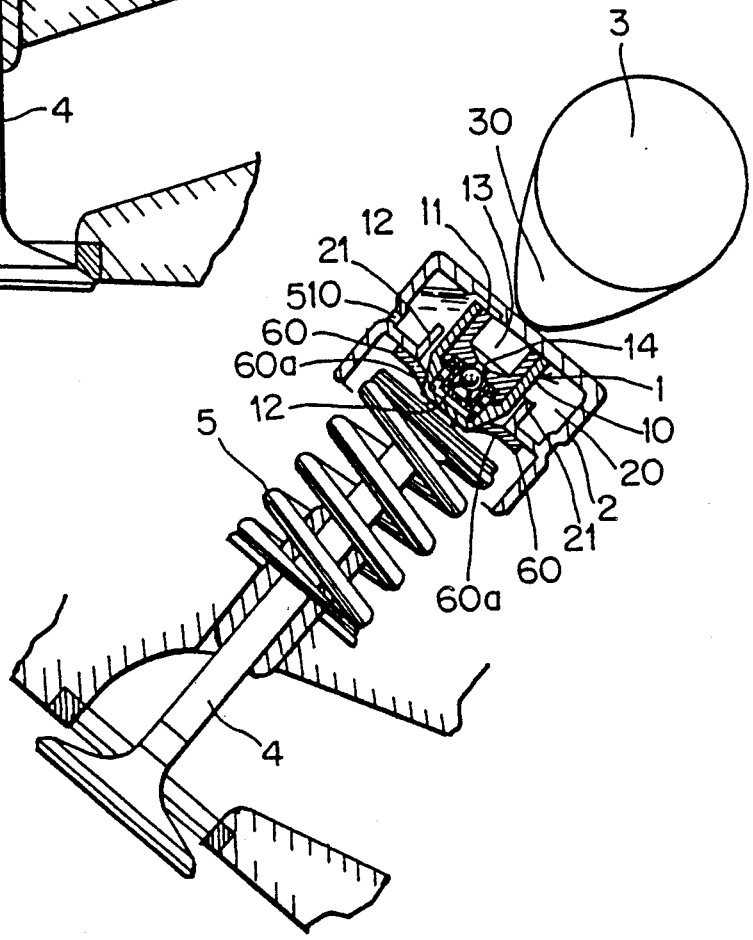

OIL PRESSURE RUSH ADJUSTER OF A DIRECTLY ACTING TYPE

BACKGROUND OF THE INVENTION

This invention relates to an improvement of an oil pressure rush adjuster of a directly acting type which is incorporated with an oil pressure unit within a bucket.

A "bottomed" condition herein refers to such a condition that an oil pressure unit is displaced a maximum amount by a cam nose as seen in FIGS. 2 and 9.

A valve actuating mechanism used in an internal combustion engine is subject to influences of wears or thermal expansions, whereby a space or a clearance formed at the valve is deformed during operations and gives bad influences to outputs and makes noises. An oil pressure rush adjuster has been therefore used to rectify the problems caused by the deformed space.

A directly actuating valve mechanism is known which is light in weight with a cam directly striking a shaft end of a valve, and this mechanism has been also employed with the oil pressure rush adjuster as shown in FIG. 8.

The oil pressure rush adjuster is composed of a bucket X and the oil pressure unit Y housed therewithin, and is placed between a cam 300 and the shaft end of a valve 400.

The oil pressure unit Y is slidably mounted on the outer circumference of a cylindrical plunger 101 having an oil hole 104 at its bottom, and comprises a cylindrical body 100 defining a high pressure chamber 102 together with the bottom of the body 100; a spring member 105 provided in the high pressure chamber 102 and biasing the body 100 downward; a check valve 106 disposed in the high pressure chamber for opening and closing the oil hole 104; and a valve spring 107 supporting the check valve 106 and a check valve cage 108 in the high pressure chamber 102.

The oil pressure unit Y is housed in the bucket X, defining a main reservoir 103 as an oil storage between the rear side of a face disc 202 and the hollow portion of the plunger 101 as well as a sub-reservoir 200 communicating, via an overflow recess 203, with the main reservoir 103 partitioned with the circumferential wall of the plunger 101, the sub reservoir 200 being supplied with the actuating oil through an oil feed hole 500 of a cylinder head and an oil hole 510 of the bucket X.

On the other hand, a cam 300 contacts the face disc 202 of the bucket X, while the shaft end of the valve 400 contacts the closed face of the body 100, so that the cam 300 strikes the shaft end of the valve 400 via the oil pressure rush adjuster.

The oil pressure rush adjuster makes use of a rigidity of the actuating oil effected when exerting pressure to the actuating oil filled in the high pressure chamber 102, and the restoring force of the spring member 105 which when releasing the pressure so as to correct the space which has been thermally deformed in the valve actuating mechanism.

A part of the oil to be supplied to the sub-reservoir 200 leaks via a space between the outer circumference of the oil pressure unit Y (the outer circumference of the body 100 in the drawing) and the sleeve 201 forming a partition of the sub-reservoir 200.

If the oil leaks while the engine operates but since the actuating oil is supplied into the sub-reservoir 200 from an oil field hole 500 of a cylinder head and an oil hole 510 of the bucket X, no special problems arise. But once the engine stops, the oil is not supplied from the cylinder head until re-starting the engine. Especially when the engine stops which is furnished with a rush adjuster under an oblique state, sufficient amounts of the oil cannot be secured in the both reservoirs 103, 200 due to the oil leaking. When the engine re-starts, there arises a possibility that air is drawn together with the actuating oil from the reservoir 103 into the high pressure chamber 102.

When the internal combustion engine stops while a cam nose 301 keeps pressing the face disc 202 of the bucket X, the oil pressure unit Y is compressed as shown in FIG. 9, that is, it is most shortened (bottomed condition). If the engine re-starts under this condition, the sliding stroke between the plunger 101 and the body 100 is maximum, and the oil is drawn into the high pressure chamber 102. But since the oil is not supplied thereinto from a cylinder head, as said above while the engine stops, the oil amount is reduced in the main and sub-reservoirs. Therefore air is drawn into the high pressure chamber 102 as much, and the rigidity of the actuating oil which is generated in the chamber 102 is considerably reduced when the plunger 101 is pressed, so that the space of the valve cannot be rectified (the rigidity is changed to be soft, and called as "sponge" condition).

SUMMARY OF THE INVENTION

In view of the above stated problems of the prior art, the present invention has been devised, and although a part of the oil is allowed to leak while the engine operates, the leak is perfectly permitted while the engine is at rest.

This invention is characterized by providing a sealing device on the outer circumference of the oil pressure unit (a position corresponding to the outer circumference of the body 100 in the above mentioned example), or on the partitioning wall of the sub-reservoir surrounding the oil pressure unit, or therebetween so as to provide a sealing between said partitioning wall and said outer circumference of the oil pressure unit while the engine is stopped and allow a portion of the oil to leak therebetween while the engine drives.

Since the oil is perfectly prevented, while the engine stops, from leaking between the outer circumference of the oil pressure unit and the partitioning wall of the sub-reservoir, the oil amount in the reservoirs is sufficient even though not supplied from the cylinder head, and the air cannot be absorbed into the high pressure chamber.

On the other hand, since the actuating oil is supplied, while the engine drives, from the cylinder head, and if the sealing is perfectly provided between the outer circumference of the oil pressure unit and the partitioning wall of the sub-reservoir, the oil is prevented from circulating. Thus, the present sealing device allows a portion of the oil leaking therebetween while the engine operates so that the oil may circulate. However, the leaking amount is naturally smaller in comparison with a case of having no sealing device. Depending upon such a structure, if the actuating oil mixing the air goes into the high pressure chamber, it is possible to exhaust it outside as a leaking amount.

BRIEF DESCRIPTION OF THE DRAWINGS

FIG. 1 is a cross sectional view showing an oil pressure rush adjuster according to the invention as applied to a valve actuating mechanism of a directly actuating type;

FIG. 2 is a cross sectional view showing a bottomed condition of the oil pressure unit when the cam contacts the face disc of the bucket with its cam nose;

DETAILED DESCRIPTION OF THE INVENTION

Figure 3:
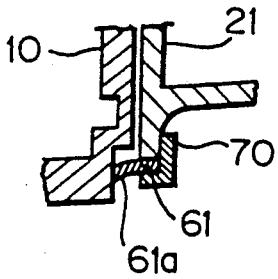
FIG. 3 is a portion cross sectional view of another embodiment.

In the drawings, 1,Y are oil pressure units; 10,100 are bodies; 11,101 are plunger; 12,102 are high pressure chambers 13,103 are main reservoirs; 14,104 are oil holes; 20,200 are sub-reservoirs; 21 is a partitioning wall; 201 is a sleeve; 22,202 are face discs; 3,303 are cams; 30,301 are cam noses; 60,61,62,63,64,65 are sealing members.

Actual embodiments of the invention will be explained in reference to the attached drawings.

FIGS. 1 and 2 of the drawings show one example of the invention.

In the drawings, the reference numeral 1 is an oil pressure unit; 10 is a body partially making up the 1; 11 is a plunger also partially making up the unit 1; 12 is a high pressure chamber defined between the body 10 and the plunger 11; 13 is a main reservoir defined in the plunger 11; 14 is an oil hole communicating between the high pressure chamber 12 and the main reservoir 13; 2 is a bucket; 20 is a sub-reservoir defined with a partitioning wall furnished within the bucket 2; 3 is a cam; 4 is a valve; and 5 is a valve spring.

In the present embodiment, a sealing member 60 of a circular shape is attached to the bottom of a partitioning wall 21 of the sub-reservoir 20 so that an inner circumferential edge 60*a* of the sealing member 60 is contacted to an outer circumference of a closed side of a body 10 reduced in diameter, said sealing member becoming smaller in thickness as going to the inner side.

In this sealing member 60, when the engine stops, the inner circumferential edge 60*a* contacts the outer circumference of the closed side of the body 10 so as to seal a space between the body 10 and the partitioning wall 21 and prevent the oil leaking from the sub-reservoir, irrespective of whether the cam 3 contacts a face disc 22 of bucket 2 at its circular base as shown in FIGS. 1 and 2, or at its cam nose 30. It is assumed that the oil leak is greatest when the rush adjuster is tilted as shown in FIG. 2 and the engine stops in a state in which cam 3 contacts the face disc 22 at its cam nose 30 (i.e., bottomed condition). However the leaking of the oil is avoided, and the sufficient oil amounts may reside in the reservoirs 13, 20 though oil is not supplied from the cylinder head, and air can be prevented from going into the high pressure chamber 12 when the engine re-starts.

During operating of the engine, the inner circumferential edge 60*a* of the sealing member 60 is deformed due to the pressure of the actuating oil sent from the cylinder head, and a space or clearance is created in relation with the outer circumference of the closed side of the body 10, and the oil partially leaks therefrom. Although the actuating oil circulates from the cylinder head to the reservoirs 13, 20 and the oil mixing the air flows in, it may be exhausted from the space.

By closing the space between the outer circumference of the body 10 and the partitioning wall 21 of the sub-reservoir 20, the actuating oil stored in the main reservoir 13 and the sub-reservoir 20 is less likely to flow out from the oil hole 510 of the bucket 2.

FIG. 3 shows another embodiment in which a ring shaped sealing material 61 is attached with a patch 70, as seen in the preceeding embodiment, to the lower end of a vertical side of the partitioning wall 21 of the sub-reservoir 20, and the inner circumferential edge 61*a* which is smaller in thickness is contacted to the outer circumference of the closed side of the body 10.

Figure 4:
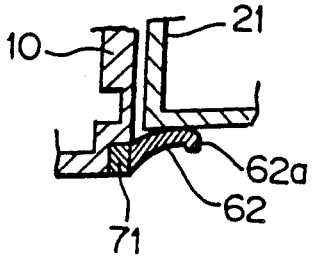
FIG. 4 is a partially cross sectional view showing another embodiment.
Figure 5:
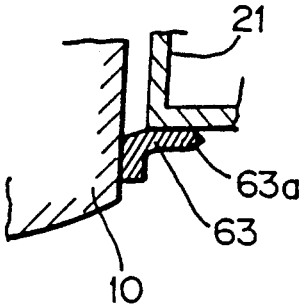
FIG. 5 is a cross sectional view showing a further embodiment.
Figure 8:
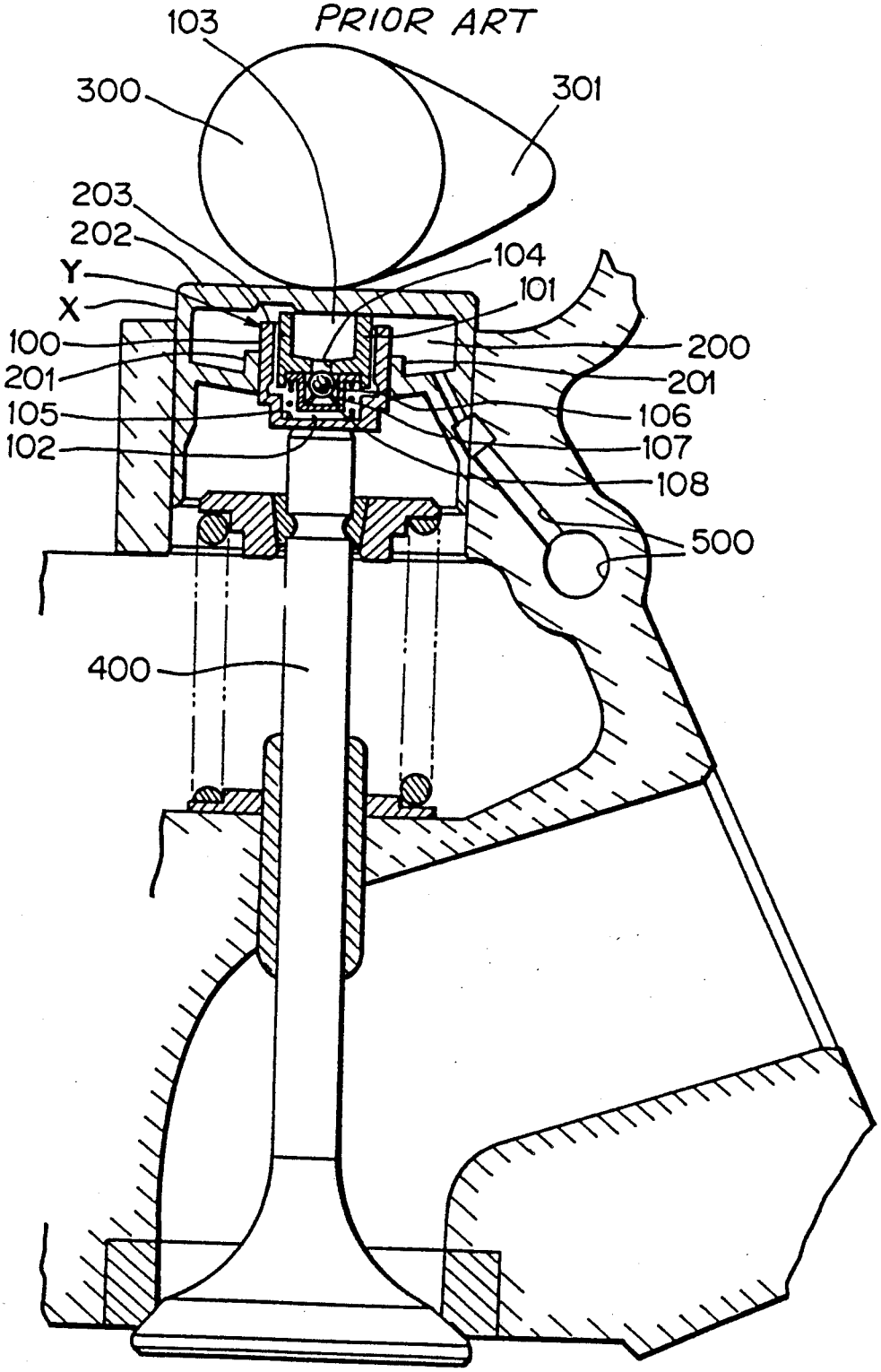
FIG 8 PRIOR ART
FIG. 8 is a cross sectional view showing a conventional example of an oil pressure rush adjuster a valve-actuating mechanism of directly acting type.
Figure 9:
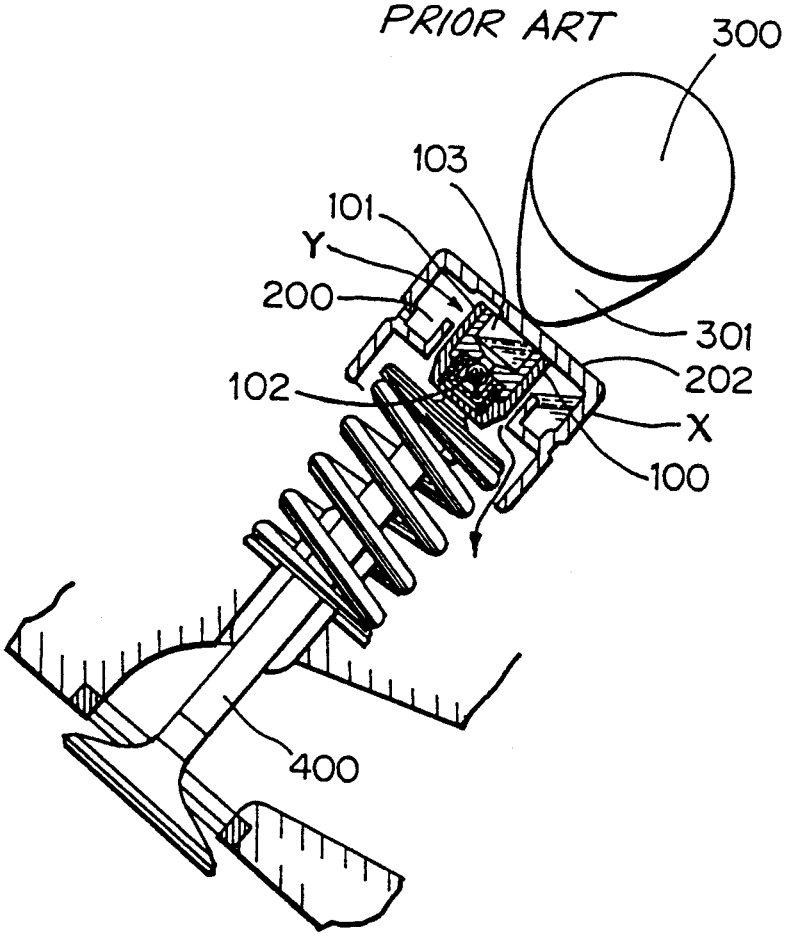
FIG 9 PRIOR ART
FIG. 9 is an explanatory view showing when the oil pressure unit is bottomed and stops with the cam nose.

FIGS. 4 and 5 show, contrary to the above embodiment, that ring shaped sealing members 62,63 are attached to directly or with a patch 71 to the outer circumference of the closed side of the body 10, and outer circumferential parts 62*a*,63*a* of small thickness are contacted to the lower sides of the partitioning wall 21 of the sub-reservoir 20.

Figure 6:
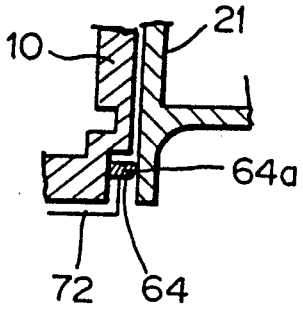
FIG. 6 is a partially cross sectional view showing another embodiment.
Figure 7:
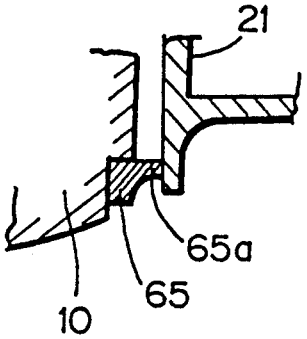
FIG. 7 is a partially cross sectional view showing another embodiment.

FIGS. 6 and 7 show that a vertical face of the partitioning wall 21 of the sub-reservoir 20 is extended downward, and flat sealing parts 64,65 of ring shape are secured directly or with the patch 72 to the outer circumference of the closed side, and end parts 64*a*,65*a* of the sealing members 64,65 contact said vertical face of the partitioning wall 21.

In the embodiments shown in FIGS. 6 and 7, if the body 10 and the partitioning wall 21 vertically slide relatively, the end parts 64*a*, 65*a* of the sealing members 64,65 always contact the vertical face of the partitioning wall 21. But the end parts 64*a*, 65*a* are deformed during operation of the engine and make a space in relation with the vertical wall 21 so that the part of the oil is allowed to flow out.

According to the invention, since the sealing device prevents the oil leak between the outer circumference of the oil pressure unit and the partitioning wall of the sub-reservoir, and if the oil pressure unit is bottomed and the engine stops, oil of a sufficient amount is provided in reservoirs, so that the air is not drawn into the high pressure chamber when re-starting the engine.

The oil is allowed to leak partially during operation of the engine, and the supply of the oil from the cylinder head is not disturbed. The leaking amount in this case is smaller than a case without the sealing device, so that an exhausting amount of an oil pump may be small and a path for an oil return from the cylinder may be small.

Since the oil leaking amount is limited as said above and if the oil mixed with air is supplied into the reservoirs, air is prevented from accumulating therein. In addition, when the oil supply force increases, the partial leakage is allowed, and since the oil pressure within the reservoirs increases in comparison with the case without the sealing, and even if the air is mixed, the oil does not miss its rigidity effected with the pressure.

It will be understood that each of the elements described above, or two or more together, may also find a useful application in other types of structures differing from the types described above.

While the invention has been illustrated and embodied in an oil pressure rush adjuster of a directly-acting type, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. In an oil pressure rush adjuster of a directly-acting type for an engine with a cylinder head, comprising a bucket having an interior partitioning wall bounding a sub-reservoir in said bucket, an oil pressure unit mounted slidably in and bounded by said partitioning wall in said bucket, said oil pressure unit being provided with a main reservoir connectable with said sub-reservoir, said sub-reservoir surrounding said oil pressure unit in said bucket supplying oil fed from said cylinder head to said main reservoir, said oil pressure unit having an outer circumference, the improvement comprising a sealing device provided on said outer circumference of said oil pressure unit so as to provide a seal between said partitioning wall and said outer circumference of said oil pressure unit when said engine is stopped and so as to allow a portion of said oil to leak between said partitioning wall and said oil pressure unit when said engine is operated.

2. The improvement as defined in claim 1, wherein said sealing device is provided on said partitioning wall surrounding said oil pressure unit.

3. The improvement as defined in claim 1, wherein said sealing device is provided between said outer circumference of said oil pressure unit and said partitioning wall surrounding said oil pressure unit.

4. The improvement as defined in claim 1, wherein said oil pressure unit, said bucket and said partitioning wall are all substantially cylindrical and said oil pressure unit has plunger slidably mounted therein provided with an oil hole, and comprises a substantially cylindrical body and a check valve.

5. The improvement according to claim 1, wherein said sealing device is a deformable ring shaped sealing member.

* * * * *